US006158365A

United States Patent [19]

Hidechika et al.

[11] Patent Number: 6,158,365

[45] Date of Patent: Dec. 12, 2000

[54] EMBROIDERING APPARATUS AND SEWING MACHINE CAPABLE OF EMBROIDERY STITCHING

[75] Inventors: Kuramoto Hidechika; Osanai Yasuhiro, both of Hachioji, Japan

[73] Assignee: Janome Sewing Machine Co., Ltd., Tokyo, Japan

[21] Appl. No.: 09/502,617

[22] Filed: Feb. 11, 2000

[30] Foreign Application Priority Data

Feb. 24, 1999 [JP] Japan ..... 11-045886

[51] Int. Cl.[7] ..... D05C 9/04

[52] U.S. Cl. ..... 112/103

[58] Field of Search ..... 112/103, 102.5, 112/470.06, 102

[56] References Cited

U.S. PATENT DOCUMENTS 4,598,655 7/1986 Takenoya ..... 112/103

4,998,964 3/1991 Golia ..... 112/103 X 5,040,476 8/1991 Takenoya et al. ..... 112/103 X 5,906,168 5/1999 Takenoya ..... 112/103

*Primary Examiner*—Peter Nerbun

*Attorney, Agent, or Firm*—Nields & Lemack

[57] ABSTRACT

The invention discloses an embroidering apparatus and a sewing machine used in combination with the embroidering apparatus which may be reduced in size for the convenience of being housed, wherein the embroidering apparatus comprises a fixedly positioned X-arm 1 and a Y-arm 4 operatively connected to the X-arm 1 which is operated to move the Y-arm 4 in the X-direction while the Y-arm 4 holds an embroidery frame 7 and is operated to move the embroidery frame 7 in the Y-direction, the Y-arm 4 being turnable relative to the X-arm 1 between a first position where the Y-arm 4 is extended normal to the X-arm 1 and a second means where the Y-arm 4 is extended in parallel with the X-arm 1, in which the size of the embroidering apparatus is reduced to the minimum.

6 Claims, 7 Drawing Sheets

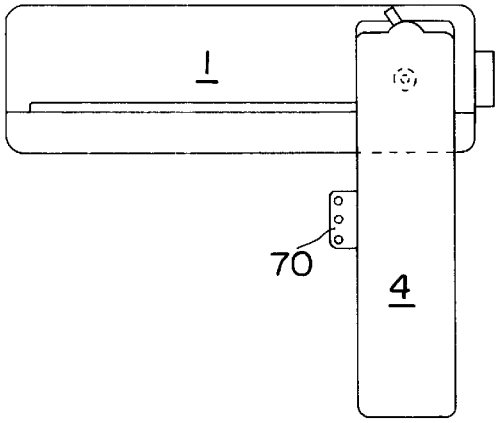
FIG. 3(A)
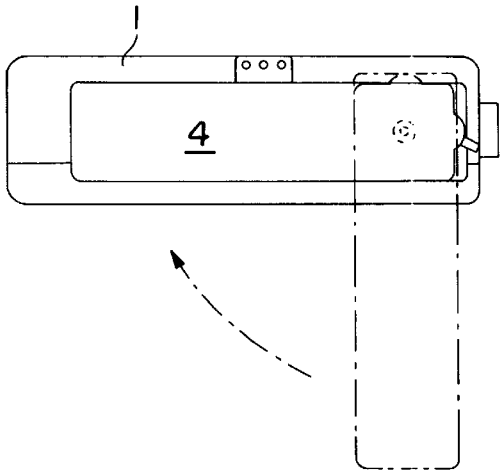
FIG. 3(B)
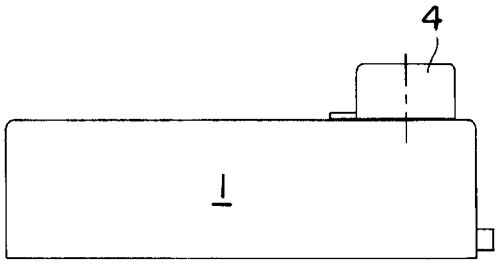
FIG. 3(A')
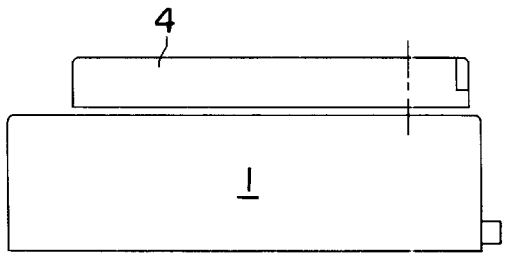
FIG. 3(B')

EMBROIDERING APPARATUS AND SEWING MACHINE CAPABLE OF EMBROIDERY STITCHING

BACKGROUND OF THE INVENTION AND RELATED ART STATEMENT

The present invention relates to an embroidering apparatus and a sewing machine capable of embroidering stitching.

It has been generally known that an embroidering apparatus is operated to move an embroidery frame, which has a work or cloth held thereon to be embroidered, in the X- and Y-directions relative to the vertically reciprocating needle, thereby to form the embroidery stitches on the work.

The embroidering apparatus generally includes two essential elements for moving the embroidery frame in the X-direction and in the Y-direction respectively, and the two essential elements are assembled with 90° relative to each other and being in the L shape.

The embroidering apparatus including such elements assembled with 90° with each other and being in the L shape has a large projection area. The embroidering apparatus is, therefore, required to have a large space for accommodating such a large apparatus therein. This has been a problem which remains to be solved.

It is the object of the invention to solve the problem as mentioned above.

SUMMARY OF THE INVENTION

For the purpose of attaining the object as mentioned above, the invention comprises a work holding means for holding a work to be embroidered thereon, a stitching means including a vertically reciprocating needle for forming the embroidery stitches on the work held by the work holding means, a first means operated to move the work holding means in a first direction relative to the needle, a second means operated to move the work holding means in a second direction relative to the needle, one of the first and second means being turnable relative to the other of the first and second means between a first position where said one of the first and second means is extended normal to the other of the first and second means and a second position where said one of said first and second means is extended in parallel with said other of the first and second means.

BRIEF DESCRIPTION OF THE DRAWINGS

FIG. 3 (A) is a plan elevational view of the embroidering apparatus shown in one operation mode;

FIG. 3 (A') is a side elevational view of the embroidering apparatus shown in FIG. 3 (A);

FIG. 3 (B) is a plan elevational view of the embroidering apparatus showing one part of the apparatus being moved from the position as illustrated with the broken line to the position as illustrated with the solid line so as to be housed;

FIG. 3 (B') is a side elevational view of the embroidering apparatus shown in FIG. 3 (A);

FIG. 5 (B) is a plan elevational view of the patterns to be embroidered the embroidering apparatus shown in the operation mode in FIG. 3 (B); one operation mode;

DETAILED DESCRIPTION OF THE PREFERRED EMBODIMENT

Figure 1A:
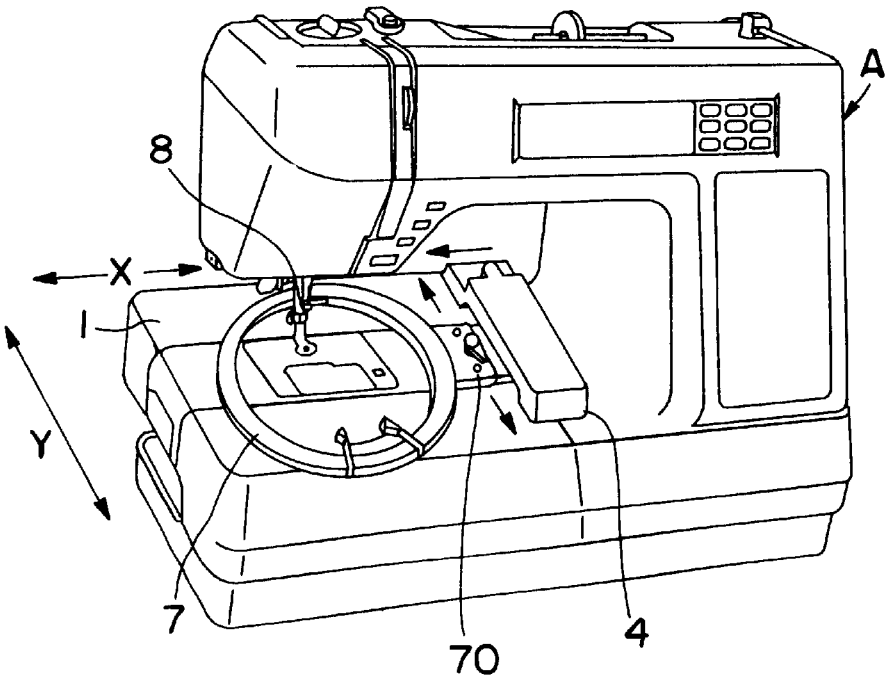
FIG. 1(A) is a perspective view of a sewing machine having an embroidering apparatus provided therewith according to the invention.
Figure 1B:
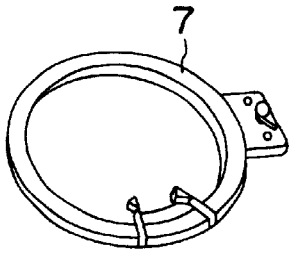
FIG. 1(B) is a perspective view of a sewing machine having the embroidering apparatus removed from the sewing machine.
Figure 1C:
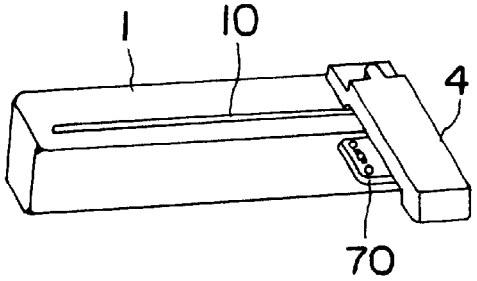
FIG. 1(C) is a perspective view of an embroidery frame to be removably attached to the embroidering apparatus.

The invention will now be described in reference to the attached drawings, wherein FIG. 1 shows a sewing machine which is capable of embroidery stitching and has the embodiment of the invention provided therewith.

Figure 2:
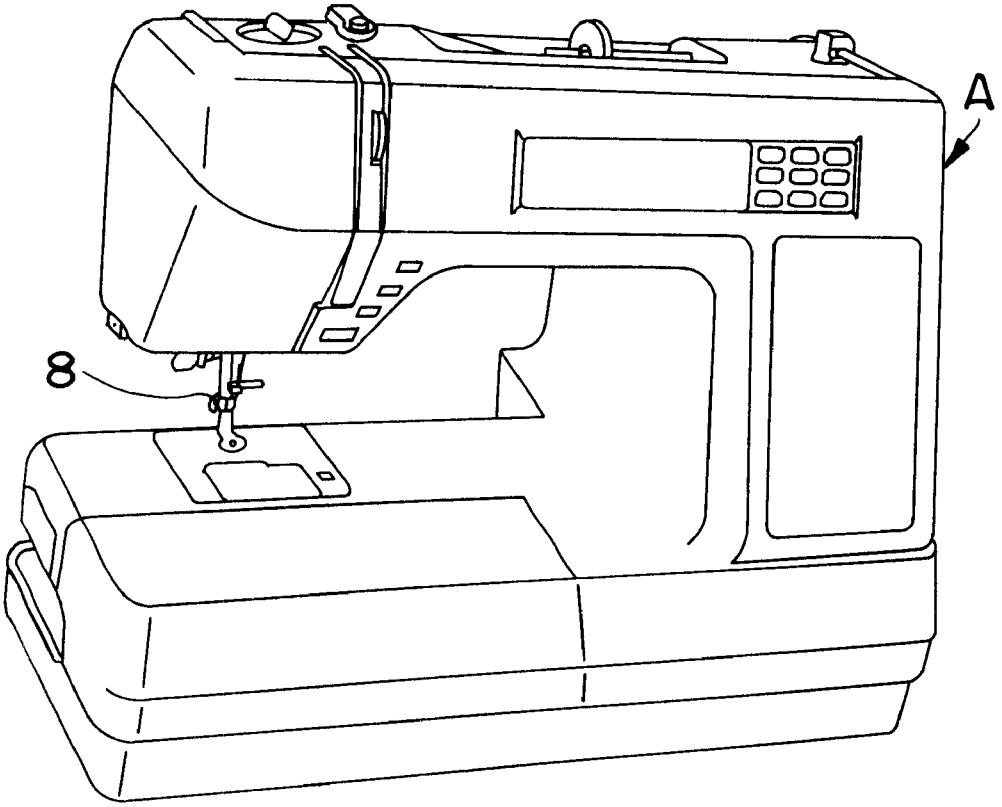
FIG. 2 is a perspective view of the sewing machine having the embroidering apparatus removed therefrom.

The sewing machine A has X-arm 1 and Y-arm 4 removably mounted thereon. FIG. 2 shows the sewing machine A, from which the X-arm 1 and Y-arm 4 are removed.

As shown in FIG. 1, the X-arm 1 is fixedly mounted on the sewing machine and extended laterally thereof, that is, in the X-direction. The Y-arm 4 has one end connected to the X-arm 1 and extended longitudinally of the sewing machine A, that is, extended in the Y-direction. The Y- arm 4 is movable in the X-direction on the X-arm. More particularly the Y- arm is connected to an X-direction motion mechanism provided in the X-arm 1 through a slit 10 of the X-arm 1 as shown in FIG. 1 (A).

A seat 70 for removably holding an embroidery frame 7 is connected to the Y-arm 4 and is movable in the Y-direction. The embroidery frame 7 is shown in FIG. 1(B) as being removed from the seat 70.

Thus the embroidery frame 7 is movable in the X- and Y-directions relative to a stitching assembly 8 of the sewing machine A including a vertically reciprocating needle, such that the embroidery stitches may be formed on a work held by the embroidery frame 7.

The Y-arm 4 is turnable between the position where the Y-arm 4 extends in the direction normal to the X-arm 1 as shown in FIG. 3 (A) and the position where the Y-arm 4 extends in the same direction with and on the X-arm 1 as shown in FIG. 3 (A') and FIG. 3 (B').

Figure 4:
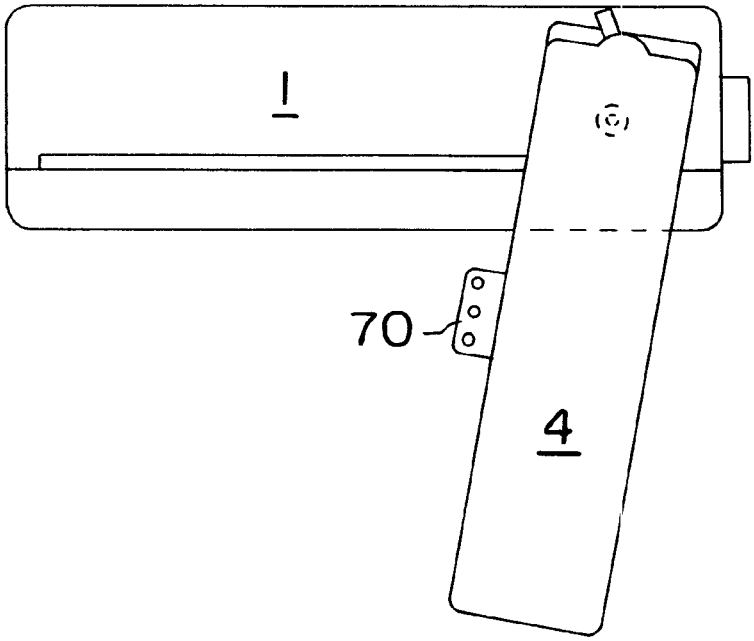
FIG. 4 is a plan elevational view of the embroidering apparatus shown in another operation mode.

According to this embodiment, as shown in FIG. 4, the Y-arm 4 may be turned in the clockwise direction relative to the X-arm 1 and may be fixed at an optional or predetermined angular position to carry out the embroidery stitching operation.

Figure 5A:
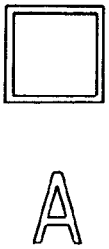
FIG. 5 (A) is a plan elevational view of the patterns to be embroidered the embroidering apparatus shown in the operation mode in FIG. 3 (A); one operation mode.
Figure 5B:
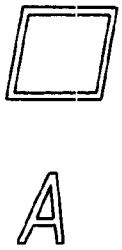

In this condition, the various patterns which are normally stitched as shown in FIG. 5 (A) may be stitched aslant as shown in FIG. 5 (B).

The inner mechanisms of the X-arm 1 and the Y-arm 4 will now be described in reference to FIG. 6 through FIG. 10 by way of example.

The X-arm 1 is composed of a casing 11 and a drive mechanism located in the casing 11. The casing 11 has the slit 10, through which a Y-frame mount 46 is partly protruded out from the inner mechanism such that the Y-arm 4 may be connected to the mount 46.

In the casing 11, there is provided an X-drive motor 20 at one end of the casing 11. The X-drive motor 20 has a drive shaft which is connected to an X-reduction gear 21 having an X-sprocket 22 provided axially therewith. The X-sprocket 22 is driven and cooperates with another X-sprocket 22' provided at the opposite end of the casing 11 to drive in the X-direction an X-transmission belt 23 which is wound around the two X-sprockets 22 and 22'.

The X-transmission belt 23 has a catch member 26 fixed thereto. An X-carriage 24 is connected to the catch member 26. The X-carriage 24 is in engagement with an X-carriage shaft 25 extending in the X-direction such that the X-carriage 24 may be moved by the X-transmission belt 23 along the X-carriage shaft 25 in the X-direction.

Figure 9:
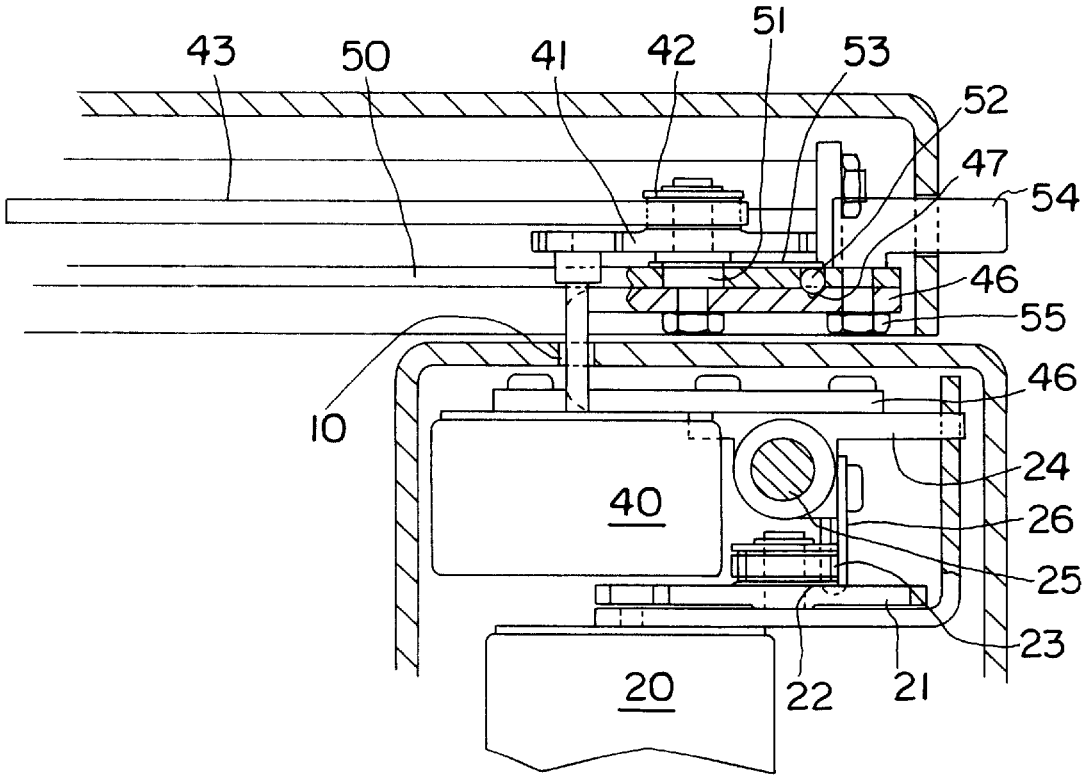
FIG. 9 is an enlarged view of the embroidering apparatus shown in FIG. 8 for explaining the inner essential mechanisms thereof.

As shown in FIG. 9, the X-carriage 24 has the sectionally U-shaped Y-frame mount 46 secured thereto. The Y-frame mount 46 has an upper end part protruded out of the slit 10 of the casing 11. The upper end part of the Y-frame mount 46 turnably holds the Y-arm 4 as will be described hereinlater.

In the Y-arm 4, there is provided a Y-frame 50 extending in the Y-direction. The Y-frame 50 has a Y-sprocket 42 provided at one end thereof axially with a Y-reduction gear 41. The Y-sprocket 42 is designed to cooperate with another Y-sprocket 42' to move in the Y-direction a Y-transmission belt 43 wound around the two Y-sprockets 42 and 42'.

A Y-carriage 44 is connected to the Y-transmission belt 43. The Y-carriage 44 is in engagement with a Y-carriage shaft 45 mounted on the Y-frame 50 and extending in the Y-direction such that the Y-carriage 44 may be moved by the Y-transmission belt 43 along the Y-carriage shaft 45 in the Y-direction.

The Y-reduction gear 41 is connected to a drive shaft of a Y-drive motor 40. The Y-drive motor 40 is located on the Y-frame mount 46 in the casing 11 and has the drive shaft protruded out of the casing 11 through the slit 10 of the casing 11. With the Y-drive motor 40 being driven, the Y-transmission belt 43 is moved in the Y-direction and the Y-carriage 44 is moved in the same direction accordingly.

The Y-carriage 44 has the aforementioned embroidery frame holding seat 70 provided thereto, by which the embroidery frame 7 is held and moved in the Y-direction. Thus the embroidery frame 7 may be moved in the X- and Y-directions as the carriage 44 is mounted on the Y-frame 50 which is connected to the X-carriage 24 by way of the Y-frame mount 46.

Figure 10:
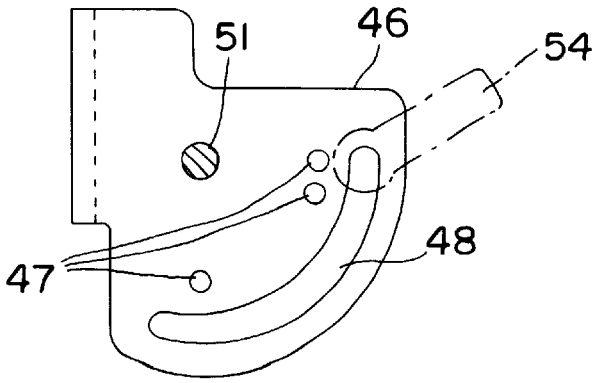
FIG. 10 is a plan elevational view of an essential part of the mechanisms of the embroidering apparatus.

A mechanism for allowing the Y-arm 4 to turn in the horizontal plane will now be described. The details of the upper end part 46 of Y-arm holding mount 46 is shown in FIG. 10. The Y-frame frame 50 is turnably mounted on the upper end part 46 of the mount 46 by way of a vertical shaft 51 provided on the upper end part 46. The upper end part 46 has a plurality of holes 47 provided thereto at the optional positions around the vertical shaft 51. The holes 47 may be optionally engaged by a ball 52 which is provided on the frame 50 and normally pressed down by plate spring 53. Thus the frame 50 my be turned around the vertical shaft 51 and brought to one of the angular positions determined by the corresponding one of the holes 47. A semicircular groove 48 is provided on the upper end part 46 coaxially of the vertical shaft 51. A manually accessible lock lever 54 has a vertical shaft provided to the inner end thereof and extending down through the frame 50, the semicircular groove 48 and the upper end part 46. A nut 55 is in threaded engagement with the lower end of the vertical shaft of the lock lever 54. The lock lever 54 may be rotated in one direction to loosen the nut 55 such that the frame 50, that is, the Y-arm 4, may be moved around the vertical shaft 51 to a position where the ball 52 may engage the optional one of holes 47 with which the ball 52 and where the lock lever 54 may be rotated in the opposite direction to tighten the nut 55 against the upper end part 46. Thus the frame 50, that is, the Y-arm 4, may be fixed to any of the optional angular positions determined by the holes 47 of the mount 46 with respect to the X-arm 1.

Figure 6:
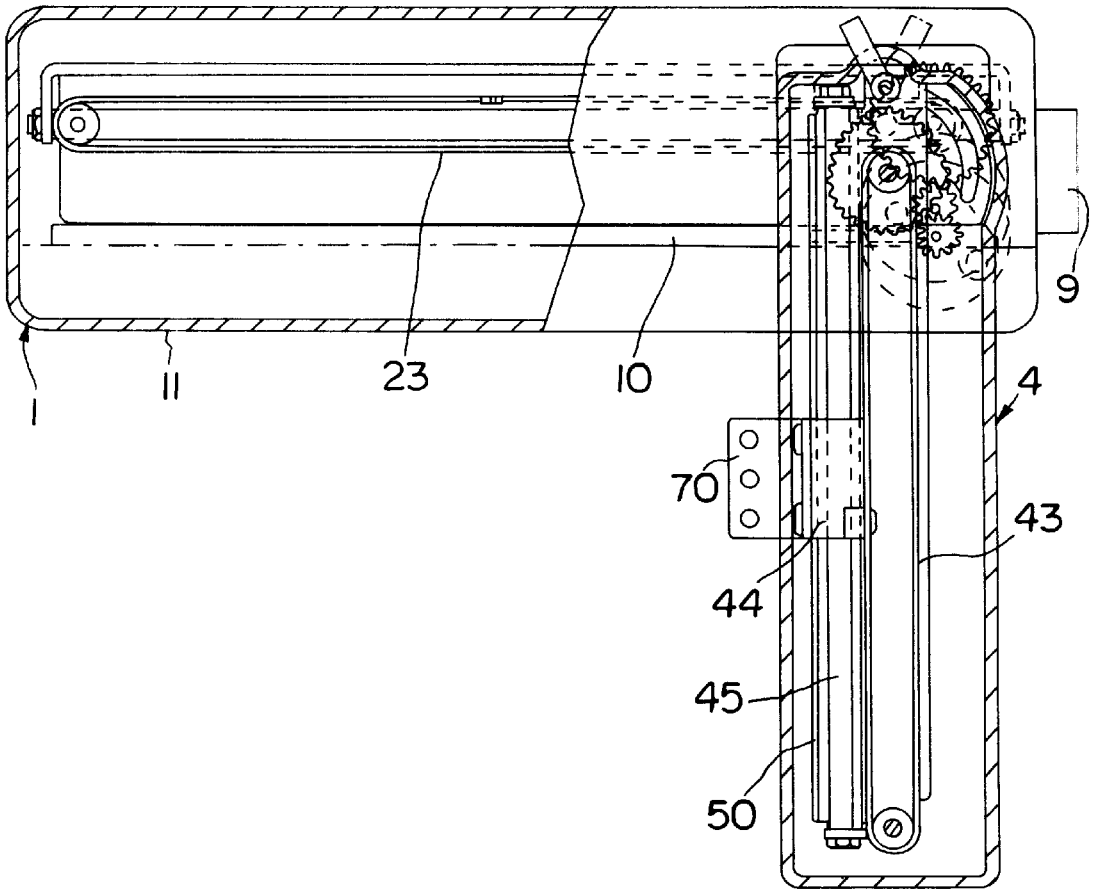
FIG. 6 is a plan elevational view of the embroidering apparatus partly broken to show the inner mechanisms thereof.
Figure 7:
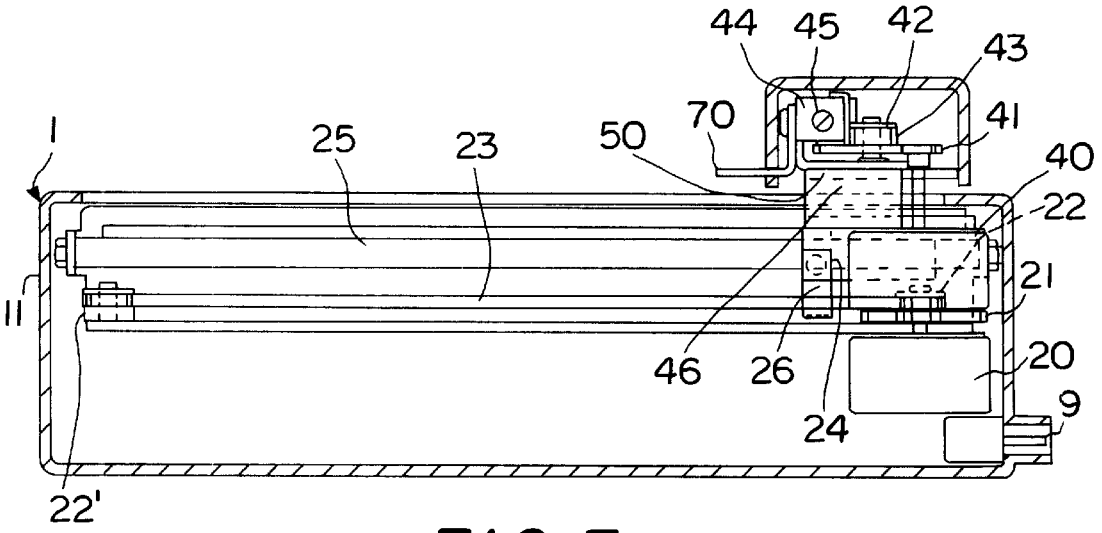
FIG. 7 is a side elevational view of the embroidering apparatus shown in vertical section to show the inner mechanisms thereof.
Figure 8:
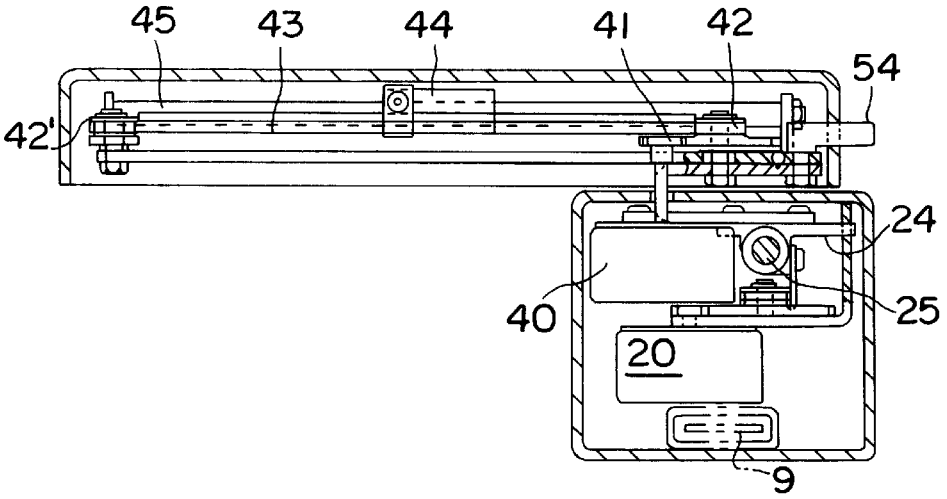
FIG. 8 is another side elevational view of the embroidering apparatus shown in vertical section to show the inner essential mechanisms thereof.

The X-arm 1 has a connector 9 provided on one side thereof as shown in FIGS. 6 and 7, such that the connector 9 may electrically connect the X-arm 1 to the sewing machine A.

With the mechanisms of the X-arm 1 and the Y-arm 4 as mentioned above, the Y-arm 4 may be brought to the position as shown in FIG. 3 (A) and (A') where the Y-arm 4 extends with 90° with respect to the X-arm 1 when the embroidery stitching operation is carried out. On the other hand, when the embroidery stitching operation is not carried out, the Y-arm 4 may be turned to a position as shown in FIG. 3 (B) and (B') where the Y-arm 4 is placed on the X-arm 1 and extends in the same direction.

As shown in FIG. 4, the Y-arm 4 may be positioned with a smaller angle other than 90° with respect to the X-arm 1 for the purpose of slanting the patterns as shown in FIG. 5 (B) which are otherwise normally stitched standard as shown in FIG. 5 (A).

According to the embodiment as described above, the volume of the housing for accommodating the embroidering apparatus therein may be remarkably reduced. Further the sewing machine and the embroidering apparatus may be packed up together in a smaller package which will remarkably reduce the package size, the transportation and storage cost as well.

Thus the embroidering apparatus and the sewing machine capable of embroidery stitching according to the invention will be effectively reduced in volume when these are housed.

What is claimed is:

1. An embroidering apparatus including an embroidery frame holding a work thereon to be embroidered, and used in combination with a sewing machine which is capable of embroidery stitching and has a stitching assembly including a vertically reciprocating needle, said apparatus comprising a first means operated to move said embroidery frame in a first direction relative to said needle; a second means operatively connected to said first means and operated to move said embroidery frame in a second direction relative to said needle; one of said first and second means being turnable relative to the other of said first and second means between a first position where said one of said first and second means is located normal to said other of said first and second means and a second position where said one of said first and second means is located in parallel with said other of said first and second means.

2. The apparatus as defined in claim 1, wherein one of said first and second means may be turned to be fixed at an optional position between said first and second positions for the purpose of embroidery stitching.

3. An embroidering apparatus including an embroidery frame holding a work thereon to be embroidered, and used in combination with a stitching device including a vertically reciprocating needle, said apparatus comprising;

a first means operated to move said embroidery frame in a first direction relative to said needle, said first means having a first end;

a second means connected to said first end of said first means and being operated to move said first means in a second direction relative to said needle;

said first and second means being turnable relative to each other at said first end.

4. The apparatus as defined in claim 3, wherein one of said first and second means may be turned to be fixed at an optional position for the purpose of embroidery stitching.

5. A sewing machine provided with said embroidering apparatus as defined in claim 3.

6. A sewing machine capable of embroidery stitching and having said stitching device as defined in claim 3.

* * * * *